United States Patent [19]

Stehle

[11] Patent Number: 4,817,291

[45] Date of Patent: Apr. 4, 1989

[54] MOTOR-DRIVEN CHAIN SAW HAVING AN IMPROVED HANDLE

[75] Inventor: Hans-Peter Stehle, Waiblingen, Fed. Rep. of Germany

[73] Assignee: Andreas Stihl, Waiblingen, Fed. Rep. of Germany

[21] Appl. No.: 102,208

[22] Filed: Sep. 29, 1987

[51] Int. Cl.[4] ..... B27B 17/00

[52] U.S. Cl. ..... 30/381; 30/383

[58] Field of Search ..... 30/381–387

[56] References Cited

U.S. PATENT DOCUMENTS 2,843,164 7/1958 Marsh ..... 30/383
3,713,466 1/1973 Lund ..... 30/381 X
3,823,474 7/1974 Ionescu ..... 30/383
4,693,006 9/1987 Wehle ..... 30/383

*Primary Examiner*—Douglas D. Watts
*Attorney, Agent, or Firm*—Walter Ottesen

[57] ABSTRACT

The disclosure describes a support handle located in the plane of a motor-driven chain saw that also includes or is near the center of gravity of the saw so as to be a "support" handle for lifting and manipulating the chain saw. The support handle is reinforced with a profiled insert of a predetermined cross-sectional configuration to distribute vibrations and other internally generally forces so they are not magnified to deform the handle. The insert has a wedge-shaped end to fit within a bend of the support handle without bending the insert.

12 Claims, 2 Drawing Sheets

MOTOR-DRIVEN CHAIN SAW HAVING AN IMPROVED HANDLE

FIELD OF THE INVENTION

The invention relates to the field of power saws and, more particularly, to motor-driven chain saws having a handle fastened beneath the saw and extending completely around the saw at a point approximating the location of the center of gravity of the power chain saw.

BACKGROUND OF THE INVENTION

Such a power chain saw handle as that with which the invention is concerned is used primarily for supporting and manipulating the angle of the saw during operation. There is, in addition, another handle usually found on power chain saws, for holding with the other hand to assist in guiding the manipulation of the chain saw, and it is located at the rear of the saw housing. This second type of handle usually has a trigger for controlling motor speed, and since the second handle is smaller without the stress that is developed in the first-described support handle, it has not experienced the problems that have plagued the support handle, particularly during operation.

Because of the severity of the manipulations that motor-driven chain saws, of the type with which the invention is concerned, are subjected, they customarily have two handles; one located at the center of gravity of the saw so that the saw can be supported and manipulated easily by the operator and a second handle, located at the rear of the saw housing, with an adjustable position switch for controlling motor speed. This second handle, although smaller than the first, is used also for a certain amount of guiding of the saw.

With these two handles, such motor-driven chain saws of the prior art can be supported and guided securely by the operator with both hands during operation. One such motor-driven chain saw is identified as Type 034 and is manufactured by Andreas Stihl. In this chain saw, the supporting and manipulating handle is attached to the saw housing on the underside thereof and extends completely around the saw housing in a spaced apart manner in a plane that includes or is in the region of the center of gravity of the saw.

The guiding handle, located at the rear of the saw housing, can be grasped by either the right or left hand of an operator. The supporting and manipulating handle, located forward of the guiding handle, therefore, must be constructed to permit grasping by the other hand of the operator, that is, from a position to the right or left of the saw housing, as well as from the top.

Several attempts have been made in the past to strengthen and to reinforce the supporting and manipulating handle. For example, one arrangement that has provided a measure of stability is a strut that is attached to the handle at its top, to one side of center, however, so that it extends downwardly and rearwardly and is attached to the saw housing. A reason for attaching the strut to one side of center is that it leaves the center free for grasping by the operator, which is where it is grasped from either side to support the saw from the top. This strut supported handle is described in U.S. Pat. No. 4,693,106.

Operators of chain saws have been known to cut the bail-type handle in half and then slip a piece of pipe over the handle. However, such field solutions often provide a loose fit and provide no support where the above-mentioned strut is attached to the handle.

The handle that is termed above as a supporting and manipulating handle is known also as a bail-type handle because it extends around the entire saw housing. This handle often is damaged or destroyed during use when it breaks loose from the saw housing at one of its points of attachment. Usually, the operator does not notice that this has occurred and continues use until damage is severe.

SUMMARY OF THE INVENTION

Accordingly, it is a principal object of the invention to provide a new and improved handle for a motor-driven chain saw.

It is also an object of the invention to provide a new and improved handle for a power chain saw adapted to withstand the rigors of hard use more readily.

A further object of the invention is to provide a construction for reinforcing a bail-type handle for a power chain saw with minimal cost.

A still further object of the invention is to provide a new and improved structure to reinforce a bail-type handle of a power chain saw in order to achieve greater flexural strength in the handle without increasing its weight unduely.

Another object of the invention is to provide a structural arrangement that is adaptable to reinforce existing bail-type handles of power chain saws.

Yet another object of the invention is to supplement the present bail-type handle of a power chain saw with a structure that will reinforce its ability to withstand the stresses of use.

Briefly, a construction that is arranged in accordance with the principles of the invention will provide support at spaced apart points along the inner surface of a hollow handle member on a power chain saw. An arrangement in accordance with the invention permits continued use of existing handle structures without re-tooling for another handle structure and the accompanying expense. Also, it should be noted that an arrangement in accordance with the invention is not limited to any particular shape of hollow handle, but it is useful equally well with round, hexagonal, pentagonal, oval or other shapes.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
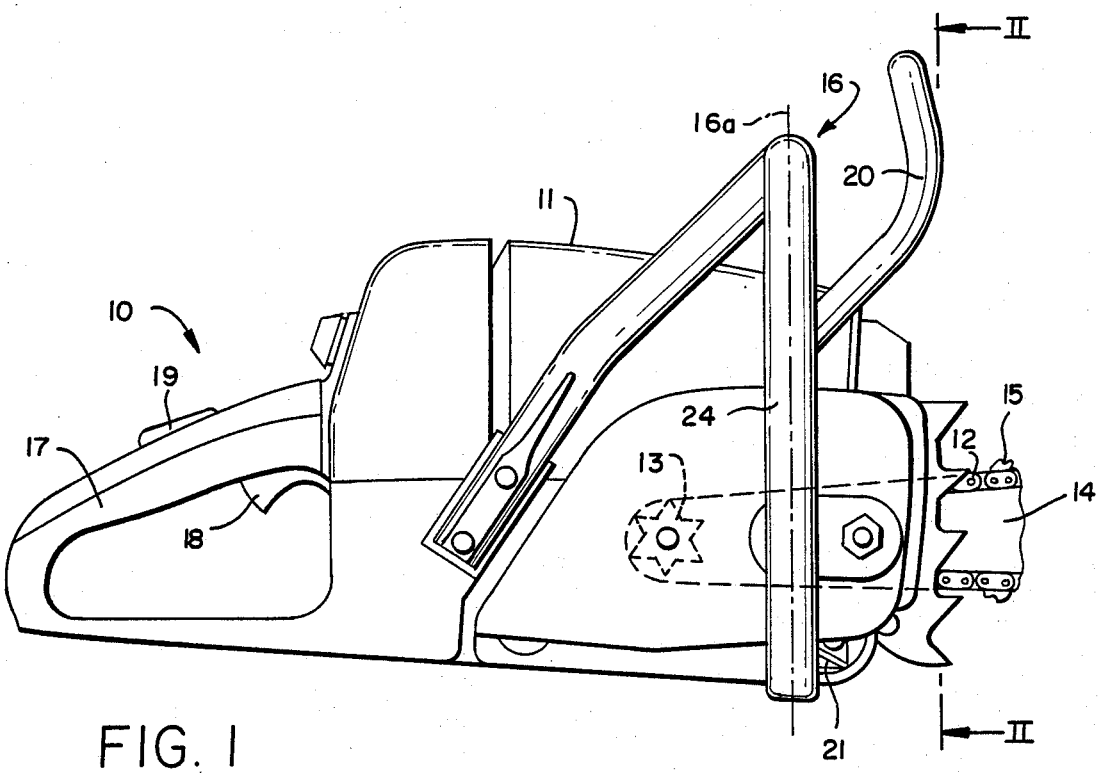
FIG. 1 is a side view in elevation of a motor-driven chain saw in accordance with the prior art.
Figure 2:
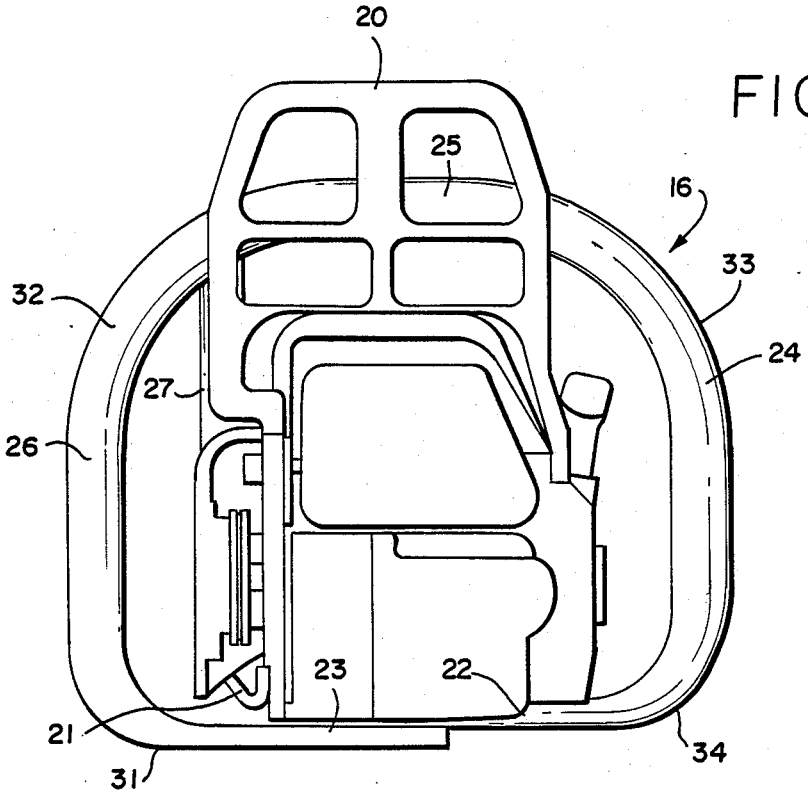
FIG. 2 is a view, also in elevation, of the motor-driven chain saw of FIG. 1 taken along the line II—II.

The motor-driven chain saw illustrated in FIG. 1 and in FIG. 2 of the drawings will assist in developing an understanding of the problem which the invention solves so uniquely. In the following description, the same reference numerals will identify the same or corresponding component parts in the various views.

FIG. 1 shows a side view and FIG. 2 shows an end view (as seen along a line II—II in FIG. 1) of a motor-driven chain saw, identified generally by the reference numeral 10, with a housing 11 to enclose a motor, either gasoline or electric, to drive a saw chain 12 by means of a sprocket 13. The saw chain 12 is supported by a guide bar 14 extending from the front of the housing 11. Usually, the guide bar 14 is made of steel that is appropriately tempered for extended operating life of the saw.

The reference numeral 15 identifies the cutting links that are part of the saw chain 12 guided about the guide bar 14 at varying speeds. The cutting links 15 have saw teeth that can have various configurations depending upon the particular cutting requirement.

The motor-driven chain saw 10 is lifted and supported in a suspended position by a handle 16 located in a plane 16a at a point on the housing 11 that includes or is in the immediate region of the center of gravity for the chain saw 10. Such a handle 16 is called a "support" handle herein.

A second handle 17 is located at the rear of the housing 11 for grasping by the other hand of an operator in order to guide the saw during normal operations and also to control the speed of the saw by means of a "trigger" type of switch 18. When the motor is gasoline driven, the switch 18 functions much like a foot-controlled accelerator in an automobile, that is, the more the switch 18 is squeezed, the faster the motor runs. For prolonged operations at a particular speed, a trigger lock 19 can be depressed so that the trigger 18 can be released.

There are several safety features connected with the chain saw 10, one of which is identified by the reference numeral 20 spaced a short distance from the support handle 16 to function as a hand guard to protect the hand of the operator. Another is a catch 21 located near the front underside of the housing 11 to stop the chain 12 in the event the latter breaks during operation.

Having identified the more prominent features customarily found on a power chain saw, the support handle 16, which embodies the invention, will now be described in more detail. The bail-type support handle 16 that is constructed in accordance with the principles of the invention is formed of a relatively light weight metal that is tempered to achieve additional flexural abilities without sacrificing strength. Weight is reduced further by forming the handle from tubular material, rather than solid, and the strength of the tubular material is optimized by using seamless tubing. The support handle can be made of aluminum, for example.

A support handle 16, according to the invention, will have one end 22 formed with any suitable way or means of attaching it to the bottom of a chain saw housing 11, and the other end 23 of the handle 16 will also have such an attaching means. The configuration of the bail-type handle 16 will be described now with reference to FIG. 1 and to FIG. 2 of the drawings.

From the end 22, the support handle material is bent at approximately 90° to extend vertically, but spaced from the side of the housing 11, for a distance illustrated by the numeral 24, to another approximately 90° bend, extending generally parallel with the part having the end 22, to form a horizontal part 25 across the top of the housing 11, but spaced above the housing 11, to a point of another approximately 90° bend extending downwardly generally parallel with the side 24, but spaced from that side of the housing 11, to form a side 26 to a final 90° bend to reach the end 23. Both of the ends 22 and 23 are fixedly and securely attached to the underside of the housing 11 so that the handle 16 forms a generally bail-type handle.

The general shape of the support handle 16 described above has been used, with several variations, in the prior art. It can be expected that a motor-driven chain saw will be subjected to vigorous use and manipulated un-delicately by strong men, and in such use, these support handles are subjected to substantial stress. The damage to these handles now is revealed by, first, exhibiting bends, twists and similar distortions in linearity before an actual break occurs. A real problem develops, however, when such deformations are un-noticed and serious physical injury results to the operator or to someone nearby.

One solution that has been attempted in the past is to provide a strut 27 that is welded to the horizontal part 25 of the handle 16, at one side, and is attached firmly to the housing 11. By attaching the strut 27 to one side instead of at the center of the horizontal part 25, it will not interfere with the hand of the operator. However, rough use and violent manipulations are not the only stresses to which the chain saw 10 is subjected on a routine and daily basis.

The rotating parts of the power chain saw 10, like in the motor and the chain itself, cause vibrations in other parts. Such vibrations are intensified at higher motor speeds and become destructive over extended periods of time. These vibrations are blamed for the bends and other deformations, as well as actual breaks, that still occur in the support handle 16.

By a structural arrangement in accordance with the invention, the destructive effects of the vibrations are relieved substantially, or eliminated entirely. The principle utilized is to develop a structure to transfer the vibrations to other parts and to distribute them more uniformly throughout the structure, rather than to isolate them and to permit the destructive forces to become magnified.

Figure 3:
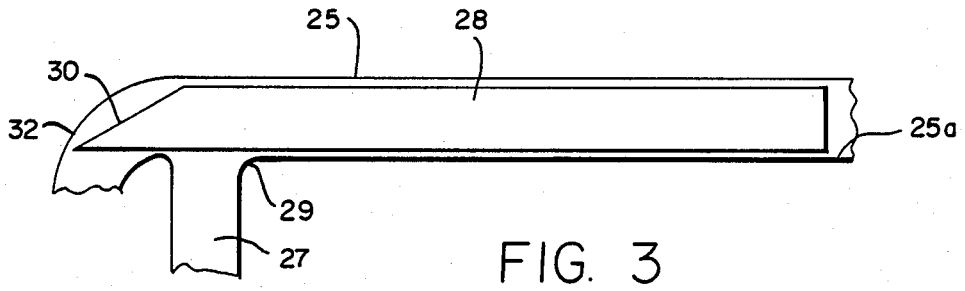
FIG. 3 is a view, in section, of the upper, horizontal part of a support handle reinforced in accordance with the invention.

FIG. 3 of the drawings illustrates the principle of the invention, which is to place a particular profile insert 28 within the horizontal part 25 of the support handle 16 in such a way as to permit the attaining of an extended operating life of the handle 16. Actual tests reveal that this improvement solves the problem that has plagued chain saws with this type of handle.

To describe the profile insert 28 with more particularity, its principal function is to prevent a break or a deformation from developing in the handle 16 in the vicinity of, or because of, the weld area 29 that attaches the strut 27 to the horizontal part 25 of the support handle 16. This weld area 29 seems to be the most troublesome point on the chain saw 10, and it seems to be the most adversely effected by heavy use, so much so that it can be called the "endangered portion" of the handle 16.

The maximum benefit from the profile insert 28 is achieved when its length is sufficient so that it extends from approximately one bend to the other, or it extends substantially across the length of the horizontal part 25 of the handle 16. It should be noted particularly that the profile insert 28 extends just beyond the location where the strut 27 is welded to the horizontal part 25 of the handle 16, and the end 30 of the profile insert 28 is wedge-shaped so that the pointed part can project into the bend to more fully protect the weld area 29, without the profiled insert 28 itself having to be bent. Thus, in this way, the profile insert 28 extends into at least one bent end of the horizontal part 25 of the handle 16, or it can fit readily into both ends if desired.

The profile insert 28 is placed in position during manufacture of the handle 16 in the following manner. After two of the bends in the handle 16 are formed, for example, the bends 31 and 32, FIG. 2, the profile insert 28 of a predetermined length is pushed into the hollow tube, and then, the remaining two bends, for example, the bends 33 and 34, are formed. Any suitable material can be used for the profile insert 28; excellent results have been obtained using aluminum which adds little to the weight of the handle 16.

Figure 4:
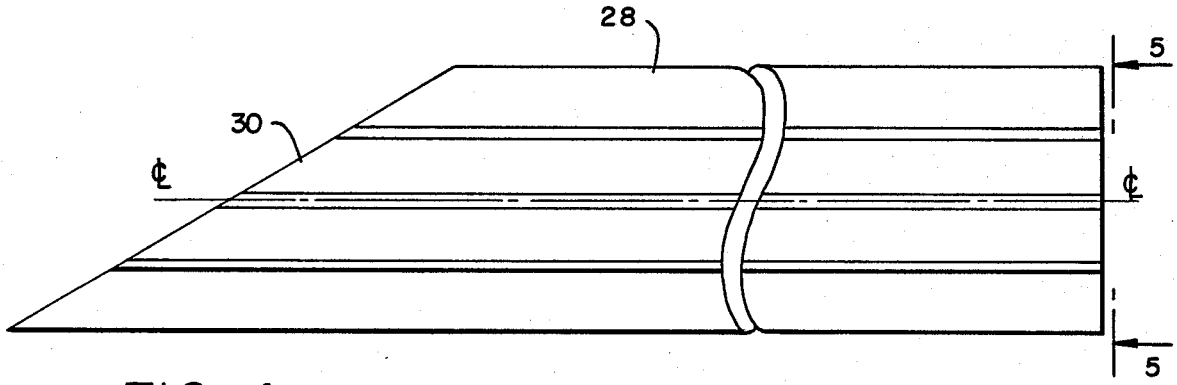
FIG. 4 is a side view of a reinforcing insert suitable for reinforcing the support handle; and, FIG. 5 is an end view of the reinforcing insert shown in FIG. 4.
Figure 5:
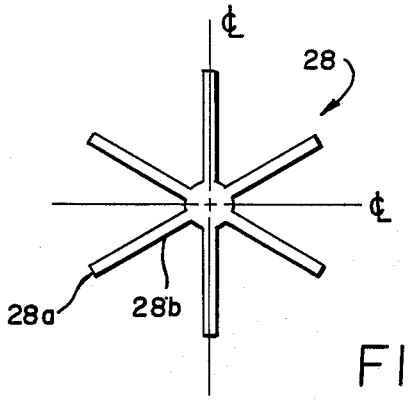

While any desired configuration can be used for the profile insert 28, the presently preferred configuration is that illustrated in FIGS. 4 and 5 of the drawings. Another configuration that is entirely suitable in some instances is a triangular configuration, not illustrated. The "star" shape that is illustrated in FIGS. 4 and 5 provides very good resistance against bending and has given unusually good results during test and is preferred for those reasons. This shape for the profile insert 28 provides inner support against the inside wall surface of the hollow tubular handle at spaced apart points that are relatively close together. Thus, the outer edges 28*a* of the arms 28*b* of the insert 28 are in tight contact engagement with the inner wall surface 25*a* of the horizontal part 25.

As pointed out hereinabove, an optimal flexural strength in the handle 16 is achieved using seamless tubing with the above-described profile insert 28 therein. An improvement of 40% in flexural strength is achieved using a tubular material with a longitudinal seam, and a further improvement of approximately 20% is achieved using seamless tubing which has been heat treated for improved hardness.

The weight of the handle 16 without the profile insert 28 shown in FIGS. 4 and 5 is approximately 450 grams, or 15.75 ounces, and the weight of the handle 16 with the profile insert included is 490 grams, or 17.15 ounces.

It is understood that the foregoing description is that of the preferred embodiments of the invention and that various changes and modifications may be made thereto without departing from the spirit and scope of the invention as defined in the appended claims.

What is claimed is:

1. In a motor-driven chain saw, including:

housing means for substantially enclosing the motor portion of said motor-driven chain saw;

guide bar means extending from said housing means in a predetermined direction for a predetermined distance for supporting and guiding a saw chain thereon;

first handle means attached to said housing means for supporting and manipulating said chain saw;

second handle means attached to said housing means at a location spaced from said first handle means for guiding said chain saw;

said first handle means comprising:

hollow tubular means of a predetermined length with a plurality of substantially 90° bends separated by substantially straight portions forming a loop around and spaced from said housing means, with at least one of said substantially straight portions located along opposite sides and across the top of said housing means;

said hollow tubular means formed in said loop having ends for attaching to said housing means in a plane that includes or is in the region of the center of gravity of said power chain saw; and, insert means of a predetermined configuration fitted within said hollow tubular means within said substantially straight portion that is located across the top of said housing means for providing support for said hollow tubular means at spaced apart points.

2. The motor-driven chain saw of claim 1, wherein said insert means includes ends terminating at a predetermined location relative to said 90° insert space bends.

3. The motor-driven chain saw of claim 2, wherein at least one of said ends of said insert means is wedge-shaped to fit within one of said 90° bends.

4. The motor-driven chain saw of claim 1 including strut means of a predetermined length with one end attached to said substantially straight portion across the top of said housing means at one of said 90° bends and the opposite end attached to said housing means to reinforce said first handle means.

5. The motor-driven chain saw of claim 4, wherein the end of said insert means nearest said strut means is wedge-shaped to provide a maximum of support at the point of attachment between said strut means and said substantially straight portion.

6. The motor-driven chain saw of claim 1, wherein said predetermined configuration of said insert means is such as to provide inner support against the inside of said hollow tubular means.

7. The motor-driven chain saw of claim 1, wherein said insert means has a star-shaped cross-sectional configuration.

8. The motor-driven chain saw of claim 1, wherein said insert means of a predetermined configuration provides inner support for the inside of said hollow tubular means at a predetermined number of spaced apart points.

9. The motor-driven chain saw of claim 8, wherein said insert is substantially star-shaped in cross-sectional configuration so as to provide inner support against the inside of said hollow tubular means at spaced apart points.

10. The motor-driven chain saw of claim 9, wherein said number of spaced apart points of said support are points located diametrically opposite each other.

11. A motor-driven chain saw, comprising:

housing means for substantially enclosing the operating motor portion of said motor-driven chain saw and having a top, two sides, a front, a rear and a bottom portion;

guide bar means extending from said housing means in a predetermined direction for a predetermined distance for supporting and guiding a saw chain thereon during use of said chain saw;

sprocket gear means to interconnect said motor portion of said motor-driven chain saw with said saw chain during use of said chain saw;

first handle means attached to said housing means in a transverse plane at approximately the center of gravity of said motor-driven chain saw for supporting and manipulating said chain saw;

second handle means attached to said housing means at a location spaced from said first handle means in a direction away from said guide bar means for guiding said chain saw during use;

said first handle means being formed of hollow tubular material having predetermined flexural strength with a predetermined length that is sufficient to encircle said housing means in a predetermined spaced apart manner and having ends for attaching to said housing means to form a bail-type handle;

said hollow tubular material forming said first handle means by a plurality of substantially 90° bends with a straight portion between at least two of said bends and said straight portion being located across said top of said housing means; and, insert means of a predetermined cross-sectional configuration fitted within said straight portion of said first handle means to support said hollow tubular material at points that are spaced apart a predetermined distance.

12. The motor-driven chain saw of claim 11, wherein said predetermined cross-sectional configuration of said insert means has a center portion with a plurality of spokes radiating therefrom to engage said hollow tubular material.

* * * * *

UNITED STATES PATENT AND TRADEMARK OFFICE

CERTIFICATE OF CORRECTION

PATENT NO. : 4,817,291

DATED : April 4, 1989

INVENTOR(S) : Hans-Peter Stehle

It is certified that error appears in the above-identified patent and that said Letters Patent is hereby corrected as shown below:

In the Abstract, line 7: delete "generally" and substitute -- generated -- therefor.

In column 1, line 65: delete "Pat. No. 4,693,106." and substitute -- Pat. No. 4,693,006. -- therefor.

In column 6, line 10: delete "insert space".

Signed and Sealed this

Seventh Day of November, 1989

*Attest:*

JEFFREY M. SAMUELS

*Attesting Officer* *Acting Commissioner of Patents and Trademarks*